US012202094B2

(12) United States Patent
Chen et al.

(10) Patent No.: US 12,202,094 B2
(45) Date of Patent: Jan. 21, 2025

(54) SYSTEM AND METHOD FOR CHEMICAL MECHANICAL POLISHING PAD REPLACEMENT

(71) Applicant: Taiwan Semiconductor Manufacturing Company, Hsinchu (TW)

(72) Inventors: Shih-Chung Chen, Hsinchu (TW); Wei-Kang Tu, Hsinchu (TW); Ching-Wen Cheng, Zhubei (TW); Chun Yan Chen, Zhubei (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 403 days.

(21) Appl. No.: 17/579,775

(22) Filed: Jan. 20, 2022

(65) Prior Publication Data

US 2023/0009839 A1 Jan. 12, 2023

Related U.S. Application Data

(60) Provisional application No. 63/219,911, filed on Jul. 9, 2021.

(51) Int. Cl.

| | |
|---|---|
| ***B24B 41/00*** | (2006.01) |
| ***B24B 29/00*** | (2006.01) |
| ***B24B 49/18*** | (2006.01) |

(52) U.S. Cl.

CPC ..... *B24B 41/005* (2013.01); *B24B 29/00* (2013.01); *B24B 49/186* (2013.01)

(58) Field of Classification Search

CPC ..... B24B 37/04; B24B 37/34; B24B 53/017; B24B 41/005; B24B 49/186; B24B 29/00

See application file for complete search history.

(56) References Cited

U.S. PATENT DOCUMENTS

| | | | | |
|---|---|---|---|---|
| 6,080,263 | A * | 6/2000 | Saito | H01L 21/67092 156/522 |
| 6,179,695 | B1 * | 1/2001 | Takahashi | B24B 41/047 451/271 |
| 6,200,402 | B1 * | 3/2001 | Amo | B29C 63/0013 156/238 |
| 6,299,519 | B1 * | 10/2001 | Easter | B24B 37/34 451/526 |
| 6,312,319 | B1 * | 11/2001 | Donohue | B24B 53/017 451/36 |

(Continued)

*Primary Examiner* — Joel D Crandall

(74) *Attorney, Agent, or Firm* — Lippes Mathias LLP

(57) ABSTRACT

A system and method for chemical mechanical polishing ("CMP") pad replacement on a CMP processing tool. A platen carrier having two or more platens is positioned within a platen cleaning process module. Each platen includes a CMP pad affixed thereto, and is capable of being independently rotated during operations. When a pad requires replacement, the platen carrier rotates towards a pad tearer tool, which extends and pivots to remove the used pad from the platen as the carrier rotates. A pad tape replacement module is positioned above the CMP tool with pad tape extending from a supply roll to a recycle roll. As the pad tape transits through the module, a backing of the tape is separated and recycled. A pad disposed in the pad tape is then applied to a platen via a pressure roller.

20 Claims, 13 Drawing Sheets

(56) References Cited

U.S. PATENT DOCUMENTS

| | | | | |
|---|---|---|---|---|
| 7,125,326 | B2 * | 10/2006 | Walsh | B24B 37/34 451/526 |
| 7,757,741 | B2 * | 7/2010 | Ametani | H01L 21/67132 156/247 |
| 7,846,289 | B2 * | 12/2010 | Tsujimoto | H01L 21/68714 156/247 |
| 7,896,050 | B2 * | 3/2011 | Yamamoto | B26F 1/3846 156/522 |
| 8,196,632 | B2 * | 6/2012 | Tsujimoto | H01L 21/67132 156/264 |
| 8,715,460 | B2 * | 5/2014 | Bandy | B32B 43/006 156/764 |
| 2001/0006879 | A1 * | 7/2001 | Walker | B24B 37/12 451/490 |
| 2003/0006021 | A1 * | 1/2003 | Pereira | B22D 11/008 164/419 |
| 2003/0022611 | A1 * | 1/2003 | Bartlett | B24D 18/00 451/458 |
| 2003/0060021 | A1 * | 3/2003 | Kurosawa | H01L 21/6836 438/455 |
| 2003/0062116 | A1 * | 4/2003 | Lee | H01L 23/562 156/267 |
| 2005/0019980 | A1 * | 1/2005 | Kurosawa | H01L 21/6835 438/107 |
| 2006/0246831 | A1 * | 11/2006 | Bonner | B24D 11/00 451/527 |
| 2010/0035515 | A1 * | 2/2010 | Marks | B24B 37/015 451/317 |
| 2010/0294416 | A1 * | 11/2010 | Yamamoto | H01L 21/67132 156/64 |
| 2012/0090763 | A1 * | 4/2012 | Okuno | H01L 21/6838 156/154 |
| 2020/0101582 | A1 * | 4/2020 | Liu | B24B 37/042 |

* cited by examiner

SYSTEM AND METHOD FOR CHEMICAL MECHANICAL POLISHING PAD REPLACEMENT

PRIORITY CLAIM AND CROSS-REFERENCE

This application claims the benefit of U.S. Provisional Application Ser. No. 63/219,911 filed Jul. 9, 2021 and titled CMP IN-SITU REPLACEMENT PAD TOOL. U.S. Provisional Application Ser. No. 63/219,911 filed Jul. 9, 2021 and titled CMP IN-SITU REPLACEMENT PAD TOOL is incorporated herein by reference in its entirety

BACKGROUND

The following relates generally to the manufacturing of semiconductor devices. During the manufacturing of semiconductor devices, multiple sequences of processing steps are performed to form electronic circuits on semiconductor substrates. One such process is chemical mechanical planarization (polishing), commonly referred to as CMP. CMP is a process for smoothing or planarizing surfaces using a combination of chemical reactions and mechanical forces.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
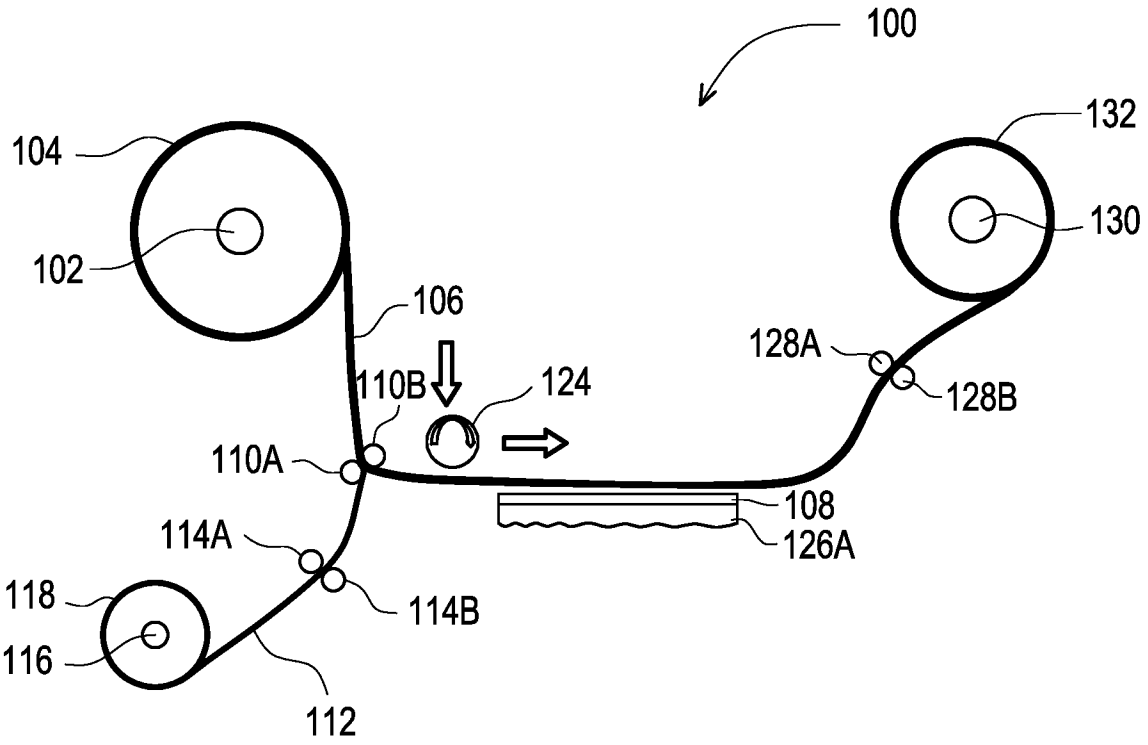
FIG. 1 is an illustration of a CMP pad tape module in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Numerical values in the specification and claims of this application should be understood to include numerical values which are the same when reduced to the same number of significant figures and numerical values which differ from the stated value by less than the experimental error of conventional measurement technique of the type described in the present application to determine the value. All ranges disclosed herein are inclusive of the recited endpoint.

The term "about" can be used to include any numerical value that can vary without changing the basic function of that value. When used with a range, "about" also discloses the range defined by the absolute values of the two endpoints, e.g., "about 2 to about 4" also discloses the range "from 2 to 4." The term "about" may refer to plus or minus 10% of the indicated number.

According to some chemical mechanical polishing (CMP) platforms, a platen is covered with a polishing pad and is configured to rotate the polishing pad. CMP polishing pads may be made of a plurality of different materials. In some implementations, the pads are manufactured from hard and porous polyurethane foam, and may be patterned with narrow high-aspect ratio grooves (i.e. to collect debris from wafers being polished). These pads may include a single layer or a composite layer of materials such as felts, polymer impregnated felts, microporous polymers films, microporous synthetic leathers, filled polymer films, unfilled textured polymer films, combinations of same, or the like. Representative polymers may include polyurethane, polyolefins, or the like.

A rotating polishing head, such as a wafer carrier, is arranged over the polishing pad, and is configured to support and rotate a workpiece, e.g., silicon wafer. The polishing head comprises concentric pressure zones configured to press corresponding concentric regions on a to-be-polished surface of the workpiece into the polishing pad with varying force. A slurry distribution system comprises one or more nozzles arranged over the polishing pad, and is configured to provide a slurry to the polishing pad through the nozzle(s). In some instances, the ultra-fine chemical polishing slurry is sprayed onto and channeled around the pad surface, via the grooves. The slurry comprises chemical and abrasive components. Due to the pressing force and the slurry, the to-be-polished surface undergoes chemical and mechanical polishing. A conditioner is arranged over the polishing pad, and is configured to remove polishing debris from the polishing pad.

As pads wear out, they must be replaced to prevent damage to wafers being polished, as well as to remain effective in performing the CMP processing. This determination may be the result of a set number of operations or period of time, as well as actually damage to the pad. To replace such pads, a technician must manually peel/scrape the used pad from the top of a platen followed by cleaning of the platen surface. In some instances, this requires the technician to remove the platen from the CMP tool to effectively remove and replace a pad. A new pad is then readied for placement on the cleaned platen by removal of backing from the pad (self-adhering pads) or by preparation of the platen surface with an adhesive. For the new pad to be effective, the technician must carefully align the new pad on the platen. After alignment, the technician must manually check the pad for flatness, i.e., the presence of any bubbles under the pad (e.g., debris or air pockets between the platen and the pad). This preventative maintenance/emergency maintenance is exceedingly time consuming and labor intensive. Any CMP tool having a pad replaced may be inaccessible for semiconductor manufacturing operations for extended periods of time, thereby slowing down fabrication within a given facility. Further, when a technician performs this type of maintenance, the 6S Safety (i.e., sort, set in order, shine, standardize, sustain, security) is impacted.

In embodiments disclosed herein, an automated pad replacement system is provided that reduces downtime of the CMP tool for pad replacement, and also reduces the amount of manual labor entailed in performing pad replacement. The automated pad replacement system provides automated hardware for removing the used pad, pressing down the new pad onto the platen, and checking for bubbles. Additionally, embodiments disclosed herein provide multiple platens in the CMP tool with a mechanism for switching between the platens. This facilitates the automated pad replacement, and also extends the time intervals between pad replacement downtime sessions by enabling all pads of the multiple platens to be replaced in one pad replacement downtime session.

Turning now to FIG. 1, there is shown a CMP pad tape replacement module 100 for automated CMP pad replacement in accordance with one embodiment. According to varying embodiments contemplated herein, the CMP pad tape replacement module 100 is configured for removable attachment to a CMP tool 300 (shown in FIG. 3). As shown in FIG. 1, the CMP pad tape replacement module 100 includes a pad tape supply roller 102 configured to store a pad tape supply 104, i.e., a roll of pad tape 106.

Although not illustrated in FIG. 1, the pad tape replacement module 100 may be affixed to a movable assembly configured to align over the CMP tool 300 to allow replacement of pads 108 on platens 126A in accordance with the methods described in greater detail below. In other embodiments, the pad tape module 100 may be configured to align along a side of the CMP tool 300, thereby allowing replacement of pads 108 on a side of the CMP tool 300, as opposed to the top surface of the tool 300. In such embodiments, the individual components of the pad tape replacement module 100 described herein may each be mounted to the referenced assembly, or may be individually placed in proximity to the CMP tool 300 to effectuate the pad replacement processes disclosed herein. The skilled artisan will appreciate that such assembly may be maneuvered into position via automated or manual means. For example and without limitation, the assembly holding the CMP pad tape replacement module 100 may be positioned on rails (not shown) or other guides to enable proper positioning of the pad tape replacement module 100 over the CMP tool 300. Such positioning may be accomplished via mechanized means, e.g., motors, pulleys, etc., alone or in combination with manual actions by a technician.

Figure 2A:
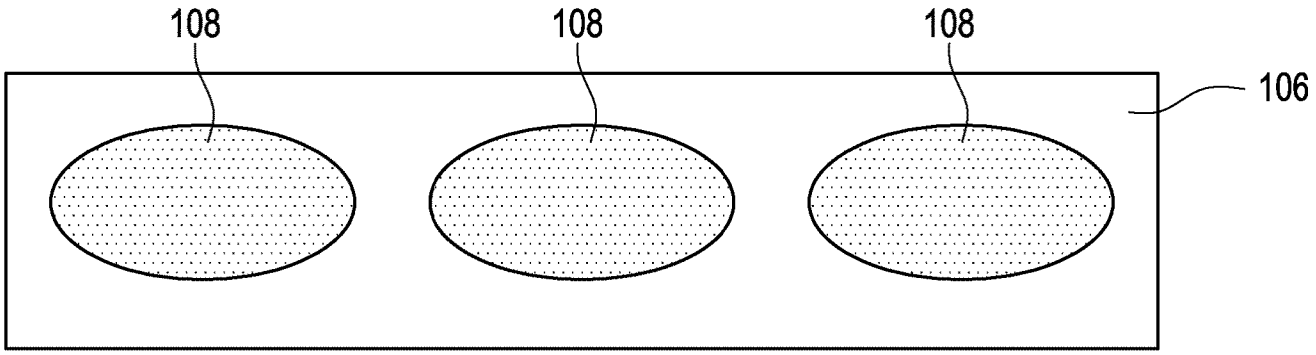
FIG. 2A is an illustration of a top view of a section of a CMP pad tape with CMP pads in place in accordance with one embodiment.
Figure 2B:
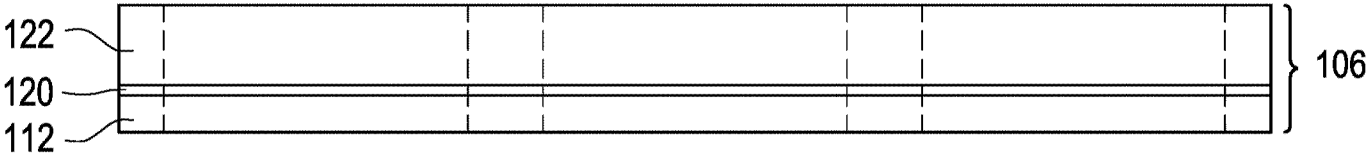
FIG. 2B is an illustration of a side view of the section of CMP pad tape of FIG. 2A in accordance with one embodiment.
Figure 2C:
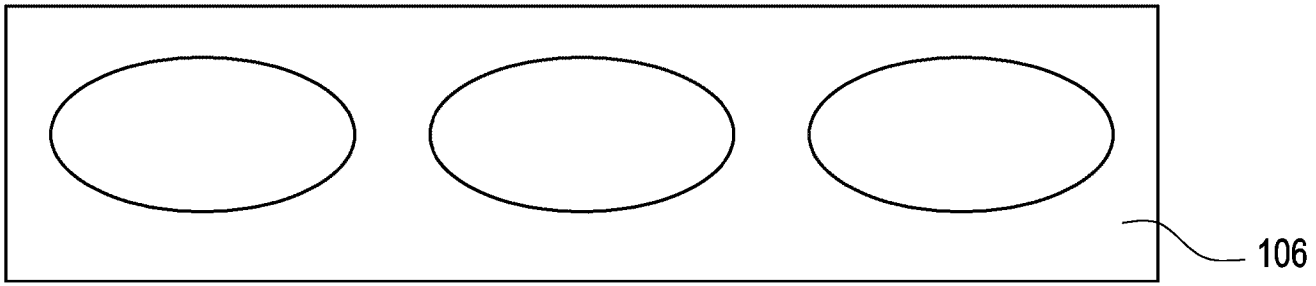
FIG. 2C is an illustration of a top view of a section of CMP pad tape after removal of CMP pads in accordance with one embodiment.

FIGS. 2A, 2B, and 2C provide images of the pad tape 106 before and after extraction of pads 108 onto a platen 126A of a CMP tool 300, as discussed in greater detail below. As shown in FIG. 2A, a section of pad tape 106 is illustrated having a plurality of pads 108 disposed therein. In some embodiments, the pad tape 106 is precut into the shape of a pad 108 that fits on a platen 126A of the CMP tool 300. In such embodiments, the pad tape 106 (shown more fully in FIG. 2B) includes a backing tape/layer 112 disposed over an adhesive layer 120 and a pad layer 122 comprising the precut pads 108. It will be appreciated by those skilled in the art that the backing layer 112 may comprise any suitable material capable of preventing the adhesive layer 120 from adhering to other materials, e.g. the pad layer 122 when presented in a roll (i.e., the pad tape supply 104). In some embodiments, the pad tape 106 may have a width greater than the diameter of the platen 126A, with the precut pads 108 on the tape 106 having the same diameter as that of the platen 126A. As a non-limiting example, when the platen has a diameter of about 520 mm, the precut pads have a diameter of about 520 mm and the width of tape is about 540 mm. Other diameters and widths are also capable of being used, and the diameter of the platen may dictate the diameter and width of the tape. It will be appreciated that such examples may utilize ranges of +/−50 mm to allow for a range of different sized platens. In some embodiments, the platen platform may rotate from 0 to 360 degrees for taping and pad removing.

Returning to FIG. 1, the pad tape 106 is initially fed through backing removal rollers 110A and 110B, wherein the backing tape/layer 112 is separated from the pad layer 122 and adhesive layer 120. The backing tape/layer 112 is then wound into a backing tape recycle roll 118 around the backing tape recycle roller 116 through backing tape recycle guide rollers 114A and 114B. In some embodiments, the backing removal rollers 110A-B, and/or the backing tape recycle roller 116 are suitably configured to turn the backing tape recycle roll 118 to collect the backing tape/layer 112 while maintaining suitable tension in the backing tape/layer 112 coming from the removal rollers 110A-B. The skilled artisan will appreciate that such tension assists in separating the backing tape/layer 112 from the adhesive layer 120 and prevents the backing tape/layer 112 from bundling or otherwise interfering with operations of the CMP pad tape replacement module 100.

Figure 3A:
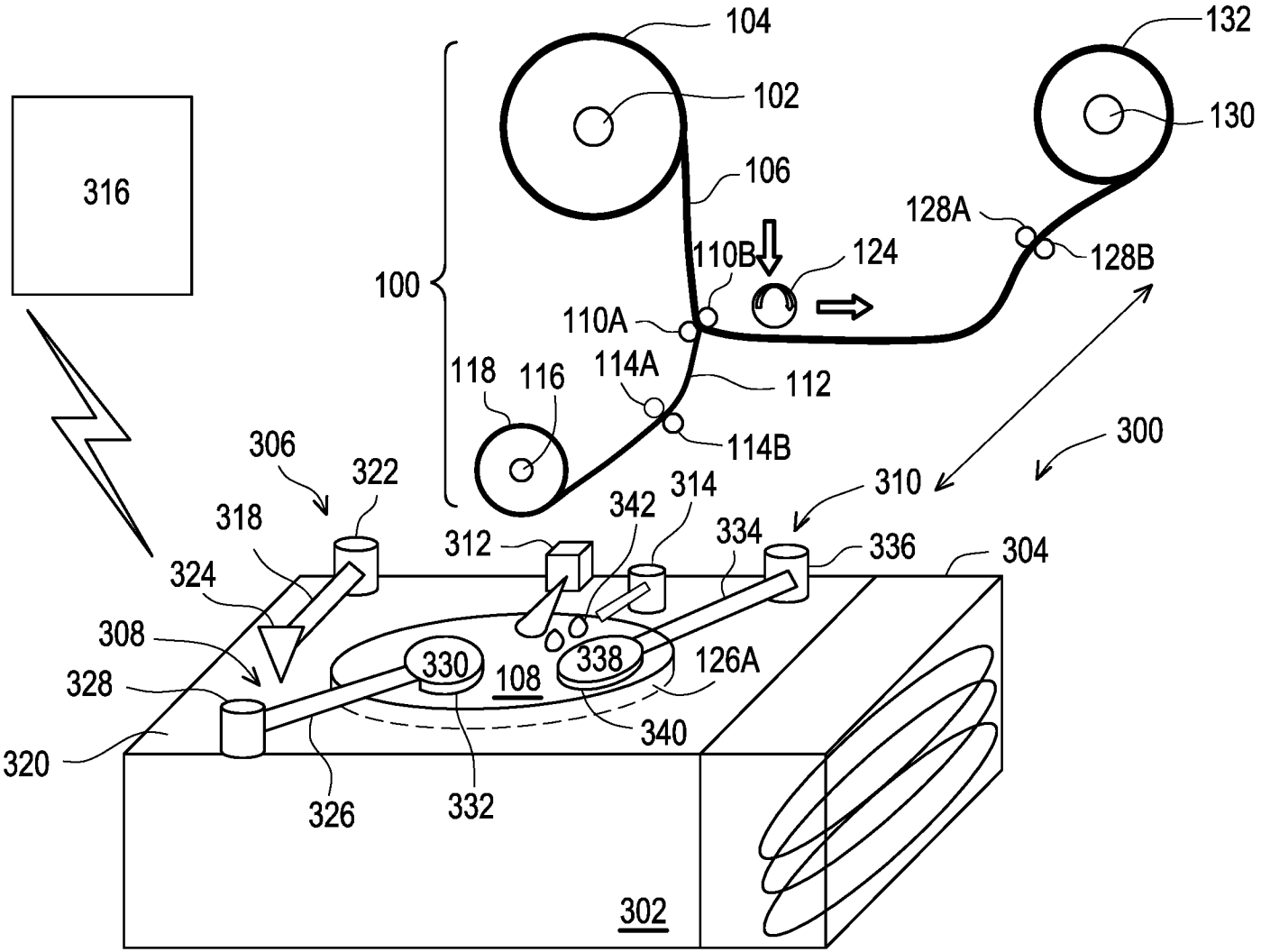
FIG. 3A is an illustration of a CMP tool in accordance with varying embodiments.
Figure 3B:
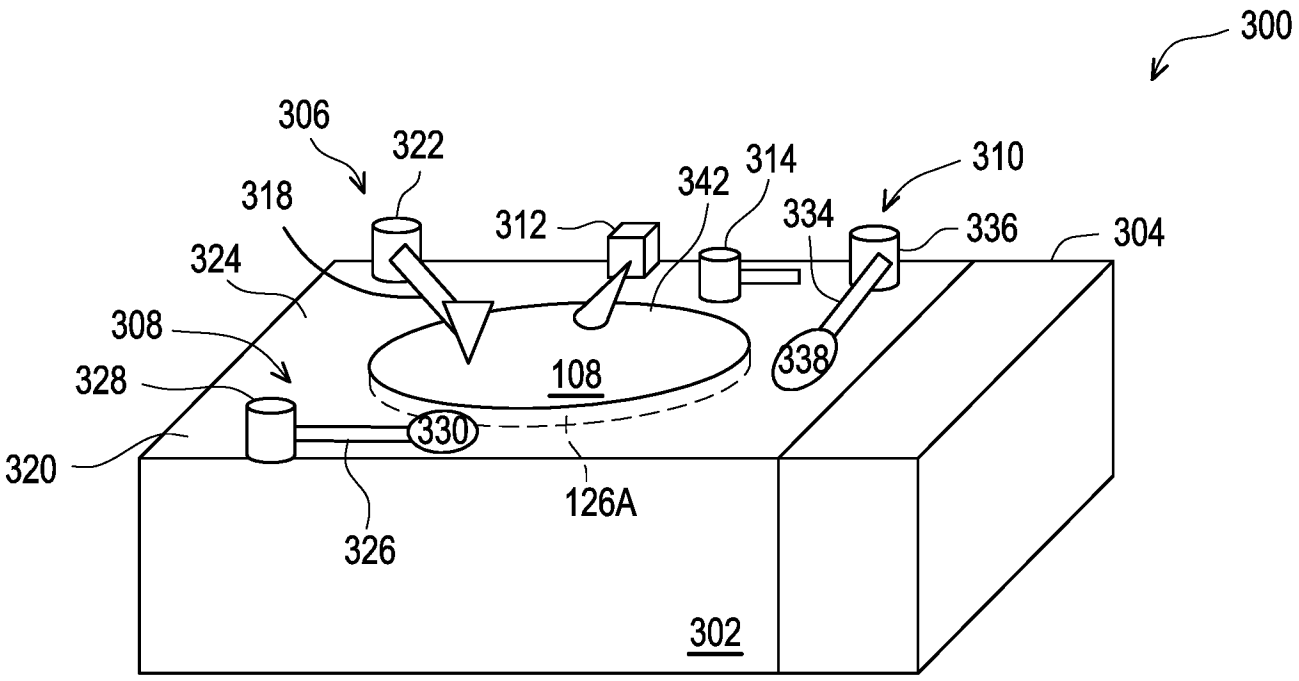
FIG. 3B is an illustration of a CMP tool in accordance with varying embodiments.
Figure 3C:
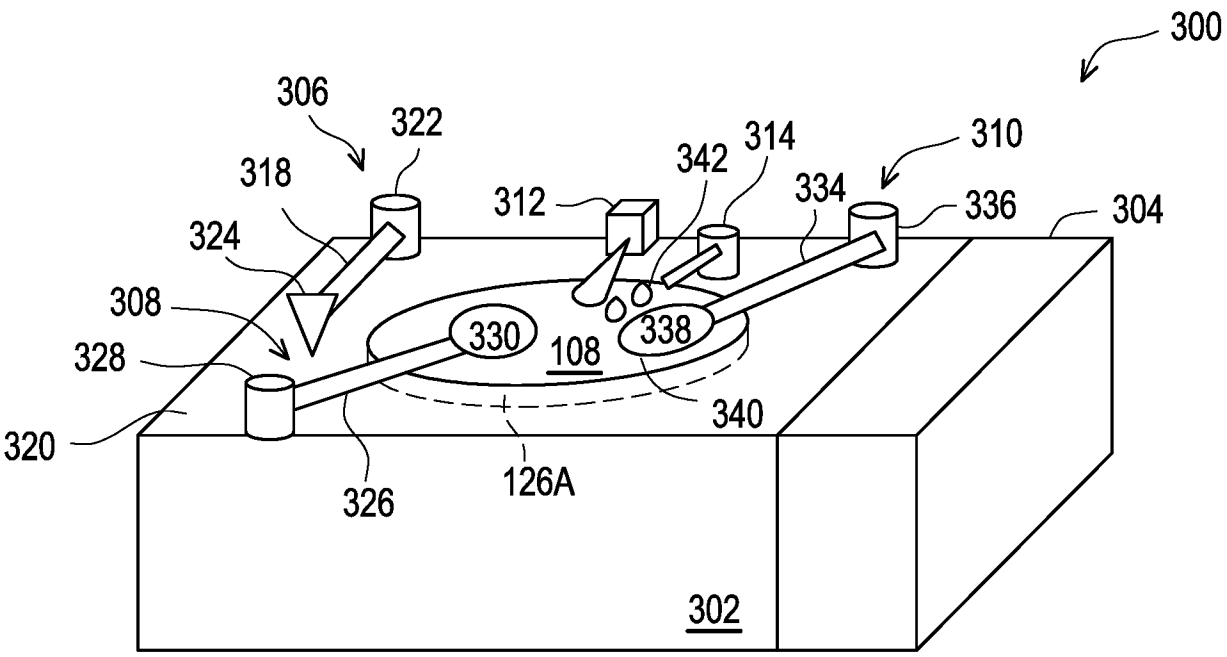
FIG. 3C is an illustration of a CMP tool in accordance with varying embodiments.

According to one embodiment, the pad tape 106, after having been stripped of the backing tape/layer 112 (i.e., the adhesive layer 120 and the pad layer 122) is directed from the backing removal rollers 110A-B over a platen 126A through pad tape recycle guide rollers 128A and 128B to the pad tape recycle roller 130, forming a pad tape recycle roll 132 of the pad layer 122. It will be appreciated by those skilled in the art that the pad tape recycle roller 130 may be suitably configured to turn the pad tape recycle roll 132 to collect the pad tape layer/adhesive layer 120 after application of a pad 108 to a platen 126A. In accordance with one embodiment, as the adhesive layer 120 and pad layer 122 are passed over the aforementioned platen 126A, a pressure roller 124 applies pressure to cause the pad 108 to adhere to the platen 126A. According to one embodiment, the pressure roller 124 is configured to transit across the platen 126A, applying equal pressure to the pad 108 on the platen 126A. It will be appreciated by those skilled in the art that the pressure roller 124 may be suitably configured to move the pressure roller 124 in multiple axes of motion (e.g. raise and lower to allow movement of pad tape 106), apply even pressure, rotate, and the like. The skilled artisan will appreciate that such pressure enables the adhesive 120 on the pad 108 to adhere to the platen 126A. The pressure roller 124 may then return to its previous position and the pad tape roller 102, the pad tape recycle roller 130, and the backing recycle roller 118 increments (i.e. rotates) one pad length so as to position a fresh pad 108 in the pad tape 106 in position above the CMP tool 300 for affixing to the next platen 126A of a platen carrier, as discussed below. The various rollers may be driven by a motor (not shown), pulley/belt assembly (not shown), geared coupling, or the like, Referring now to FIGS. 3A, 3B, and 3C, there is shown a CMP tool 300 with which the pad tape replacement module 100 may be utilized to replace a CMP pad 108 on a platen 126A in accordance with one embodiment of the subject application. As shown in FIGS. 3A-C, the platen 126A is configured to support a CMP pad 108. The platen 126A comprises a substantially planar upper surface configured to interface with an adhesive of the bottom surface of the pad 108 that is opposite the top surface of the pad 108 that facilitates polishing of an associated wafer.

The CMP tool 300 includes a platen cleaning process module 302, a pad waste bin module 304, a pad bubble detection module 306, a pad conditioner module 308, a polish head module 310, a pad wear detection module 312, a slurry flow module 314, and a CMP tool controller 316. The platen cleaning process module 302 is illustrated and described in greater detail with respect to FIGS. 4-6B.

According to one embodiment, the pad bubble detection module 306 comprises a support arm 318 laterally spaced on a top surface 320 of the platen cleaning process module 302. The support arm 318 may extend laterally over the platen 126A, from adjacent to the platen 126A and may be implemented as telescoping. The support arm 318 of the pad bubble detection module 306 may be coupled at one end to a support arm motor 322, which is operable to rotate the support arm 318 across the platen 126A and/or telescope the arm 318 as it sweeps across the platen 126A. A pad bubble detection head 324 may be positioned at a distal end of the support arm 318, opposite the end coupled to the support arm motor 322. In varying embodiments, the bubble detection head 324 is configured to detect a presence of a bubble or other disturbance/imperfection under the pad 108 during replacement thereof. The bubble detection head 324 may comprise, for example and without limitation, an optical sensor, a contact sensor, an ultrasonic sensor, or other suitable sensor capable of detecting issues on the surface of the pad 108. The support arm motor 322 and receipt/operation of the bubble detection head 324 may be controlled and operated via the CMP tool controller 316, as discussed in greater detail below. FIG. 3B illustrates the movement of the support arm 318 of the pad bubble detection module 306 across the surface of the pad 108 on the platen 126A, thereby enabling the bubble detection head 324 with associated sensors to detect the presence of any bubbles or other imperfections on the pad 108.

As indicated above, the CMP tool 300 further includes a pad conditioner module 308 comprising a pad conditioner support arm 326 on the top surface 320 of the platen cleaning process module 302. The support arm 326 may extend laterally over the platen 126A, from adjacent to the platen 126A and may be implemented as telescoping. The support arm 326 of the pad conditioner module 308 may be coupled at one end to a support arm motor 328, which is operable to rotate the support arm 326 across the platen 126A and/or telescope the arm 318 as it sweeps across the CMP pad 108 positioned on the platen 126A. A pad conditioner head 330 may be positioned at a distal end of the support arm 326, opposite the end coupled to the support arm motor 328. In some embodiments, the pad conditioner head 330 is configured to rotate a pad conditioner 332 attached thereto over the CMP pad 108.

Figure 7:
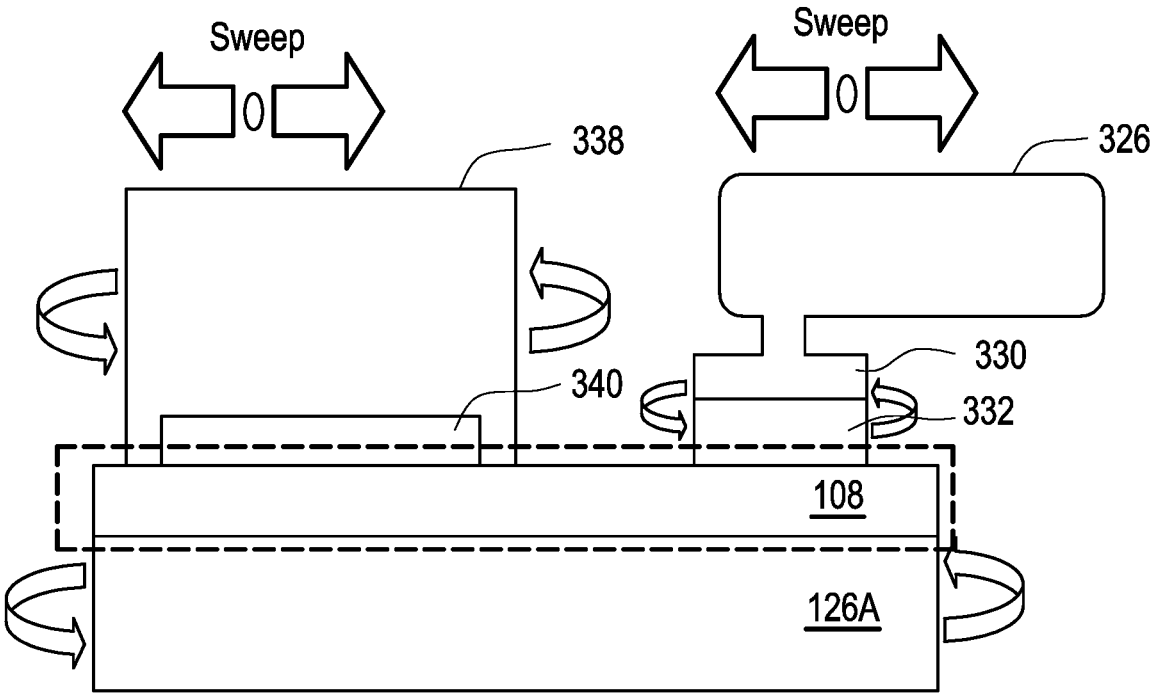
FIG. 7 is an illustration of a CMP tool in accordance with varying embodiments.

According to varying embodiments, the pad conditioner 332 may be coupled to the conditioner head 330 via mechanical or other suitable fastening means, e.g., adhesive, hook and loop fasteners, or the like. As will be appreciated by the skilled artisan, the pad conditioner 332 may comprise a substrate over which an array of abrasive particles are adhered. In varying embodiments, the pad conditioner 332 may remove wafer debris and excess slurry from the CMP pad 108 during CMP processing. In other embodiments, the pad conditioner 332 may facilitate the creation of grooves or other textures on the pad 108 against which a wafer may be polished. Rotation of the pad conditioner head 330 may be accomplished via a suitable motor (not shown), as will be understood by the skilled artisan. FIG. 3C illustrates the movement of the support arm 326 of the pad conditioner module 308 across the surface of the pad 108 on the platen 126A, thereby enabling the pad conditioner 332 to condition the CMP pad 108 during CMP processes. FIG. 7 provides a cross-sectional view of the CMP tool 300 during a CMP process in accordance with one embodiment, including the pad conditioner support arm 326, the pad conditioner head 330, and the pad conditioner 332.

The CMP tool 300 depicted in FIGS. 3A-C also includes a polishing head module 310 comprising a polishing head support arm 334 on the top surface 320 of the platen cleaning process module 302. The support arm 334 may extend laterally over the platen 126A, from adjacent to the platen 126A and may be implemented as telescoping. The support arm 334 of the polishing head module 310 may be coupled at one end to a support arm motor 336, which is operable to rotate the support arm 334 across the platen 126A and/or telescope the arm 318 as it sweeps across the CMP pad 108 positioned on the platen 126A. A polishing head 338 may be positioned at a distal end of the support arm 334, opposite the end coupled to the support arm motor 336. The polishing head 338 may be configured to hold a wafer 340 to be polished. In some embodiments, the polishing head 338 is configured to rotate the wafer 340 over the CMP pad 108 during planarization/polishing.

As indicated above, the polishing head 338 is configured to hold a semiconductor wafer 340 (see, e.g., FIG. 7) via any suitable means. For example, and without limitation, the polishing head 338 may utilize a carrier and retainer ring that is mounted to the carrier via mechanical fasteners or other suitable attachment mechanisms. During operations of the CMP process, the wafer 340 is held in place within the polishing head 340, with the surface to be polished facing down onto the pad 108. The polishing head 338 is configured to apply a downward force or pressure urging the workpiece into contact with polishing pad 108.

Located in relative proximity to the pad 108 on the platen 126A is the pad wear detection sensor module 312. The pad wear detection sensor module 312 includes one or more sensors configured to detect wear (i.e., the state) of the pad 108, e.g., loss of abrasive characteristics, damage (e.g., rips, tears, etc.) to the pad 108, or the like. Suitable sensors may include, for example and without limitation, optical sensors, infrared sensors, or the like.

In accordance with one embodiment, the CMP tool 300 further includes a slurry flow module 314 configured to dispense a slurry 342 onto the pad 108 during CMP processing. During the aforementioned CMP processing, the platen 126A rotates, which causes the slurry 342 to be distributed on the pad 108. It will be appreciated that the type of slurry 342 may depend upon the types of material to be polished or removed. For example, slurry 342 may comprise a reactant, an abrasive, a surfactant, and a solvent. The reactant may be a chemical, such as an oxidizer or a hydrolyzer, which will chemically react with a material of the wafer 340 to assist the CMP pad 108 in abrading/removing material.

In accordance with other embodiments, the reactant may be, e.g., hydrogen peroxide; although any other suitable reactant, such as hydroxylamine, periodic acid, ammonium persulfate, other periodates, iodates, peroxomonosulfates, peroxymonosulfuric acid, perborates, malonamide, combinations of these, or the like, configured to aid in removal of material may be alternatively, conjunctively, or sequentially employed. Other reactants may be used to remove other types of materials. For example, in some embodiments in which a material to be removed includes an oxide, the reactant may comprise $HNO_3$, KOH, $NH_4OH$, combinations of same, or the like. The abrasive may include any suitable particulate that, in conjunction with the CMP pad 108, is configured to polish/planarize the workpiece. In some embodiments, the abrasive may include silica, aluminum oxide, cerium oxide, polycrystalline diamond, polymer particles (e.g., polymethacrylate, or the like), combinations of these, or the like.

It will be appreciated by those skilled in the art that the control of the pad tape replacement module 100, the platen cleaning process module 302, the pad bubble detection module 306, the pad conditioner module 308, the polishing head module 310, the pad wear detection module 312, and the slurry flow module 314 may be accomplished via the CMP controller 316, as discussed in greater detail below with respect to FIG. 8.

Figure 4:
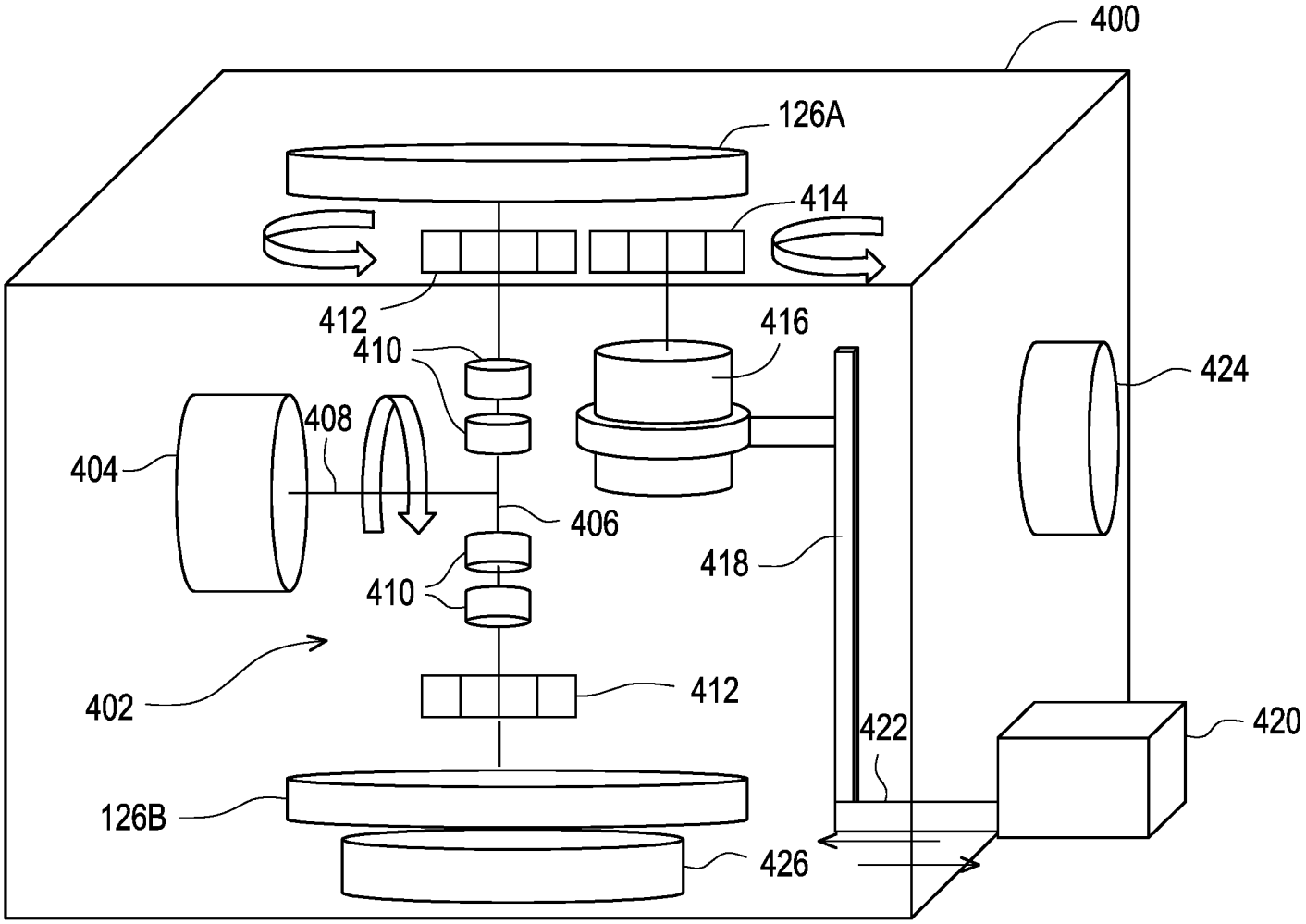
FIG. 4 is an illustration of an interior of the CMP tool in accordance with one embodiment.
Figure 5A:
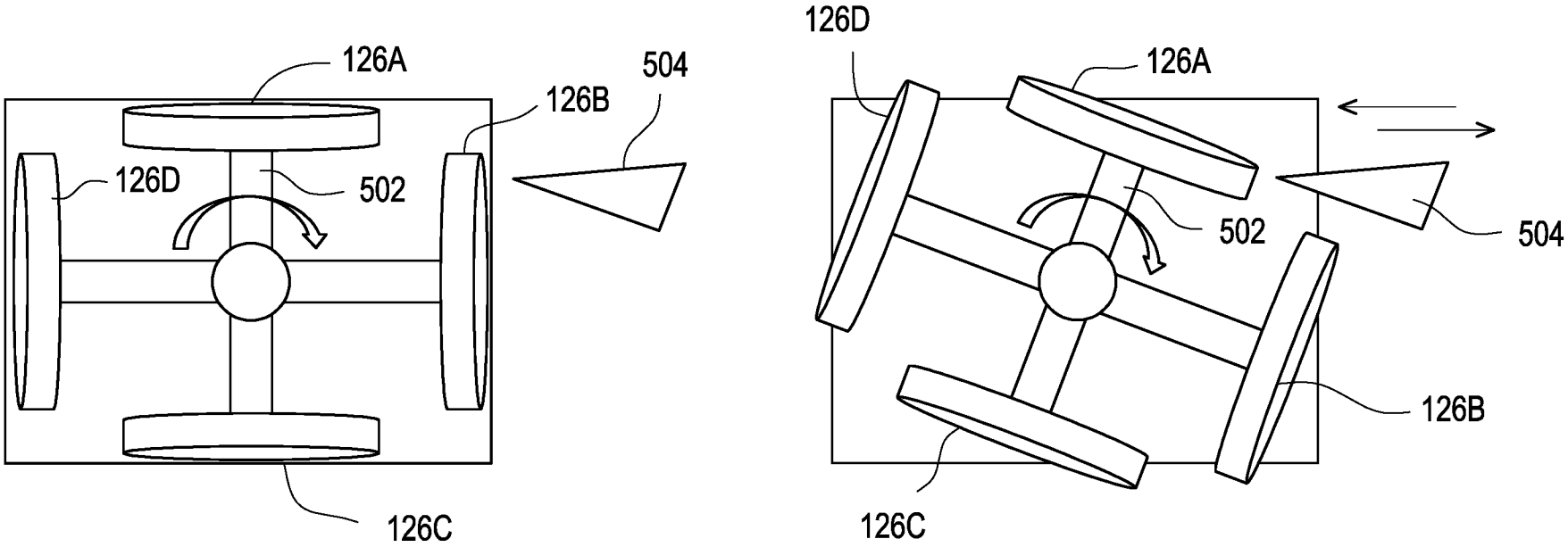
FIG. 5A is an illustration of a platen carrier in accordance with one embodiment.
Figure 5B:
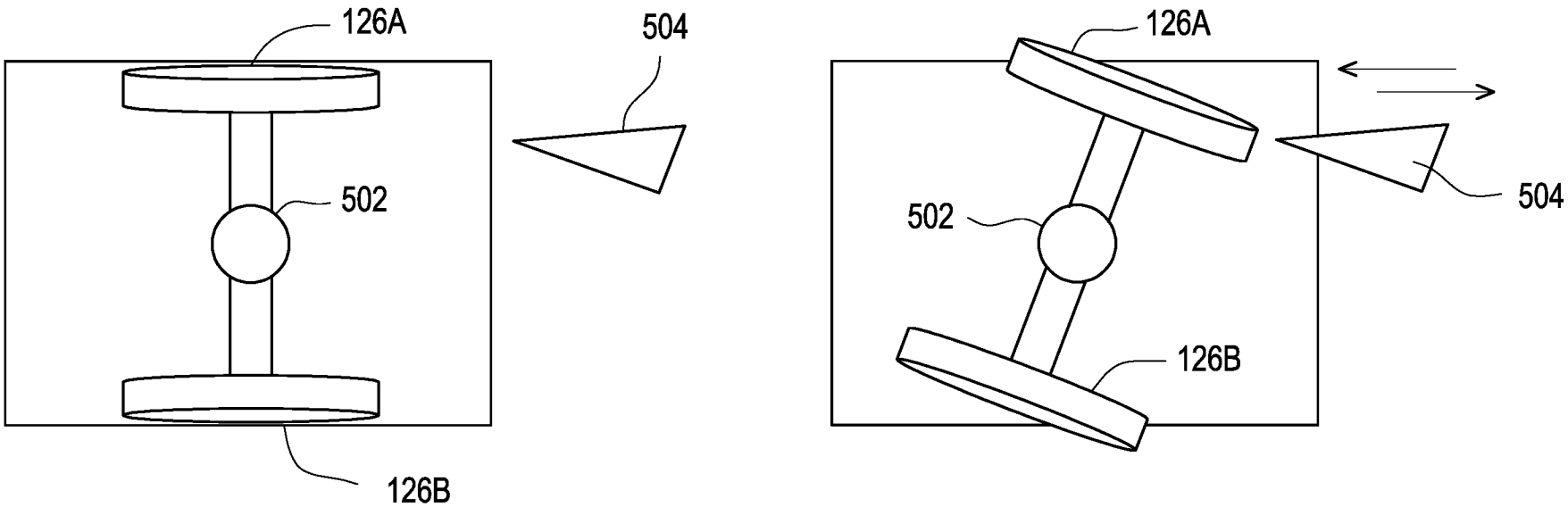
FIG. 5B is an illustration of a platen carrier in accordance with one embodiment.

Referring now to FIG. 4, there is shown an interior chamber 400 of the platen cleaning process module 302 in accordance with one exemplary embodiment. The interior chamber 400 houses a platen carrier 402 upon which a plurality of platens 126A, 126B are mounted. The platen carrier 402 may be configured to carry two, four, or more platens, each of which may be utilized in CMP processing. According to one embodiment, the platen carrier 402 is rotatable and suitably configured to rotate within the chamber 400 to alter the platen that is being used for CMP processing. FIG. 5A depicts a four-sided platen carrier 500 having four platens 126A, 126B, 126C and 126D affixed thereto. FIG. 5B depicts a two-sided platen carrier 502 having two platens 126A and 126B affixed thereto.

The interior chamber 400 of the platen cleaning process module 302 shown in FIG. 4 includes a plurality of components configured to facilitate the CMP process as well as the replacement of pads 108 in accordance with varying embodiments contemplated herein. As shown in FIG. 4, the platen carrier 402 (either the carrier 500 or 502 in FIGS. 5A-5B) is mounted to a rotation motor 404 operable to rotate the platen carrier 402 such that one of the platens 126A-D (four-sided) or 126A-B (two-sided) is positioned for CMP operations of the CMP tool 300.

Figure 6A:
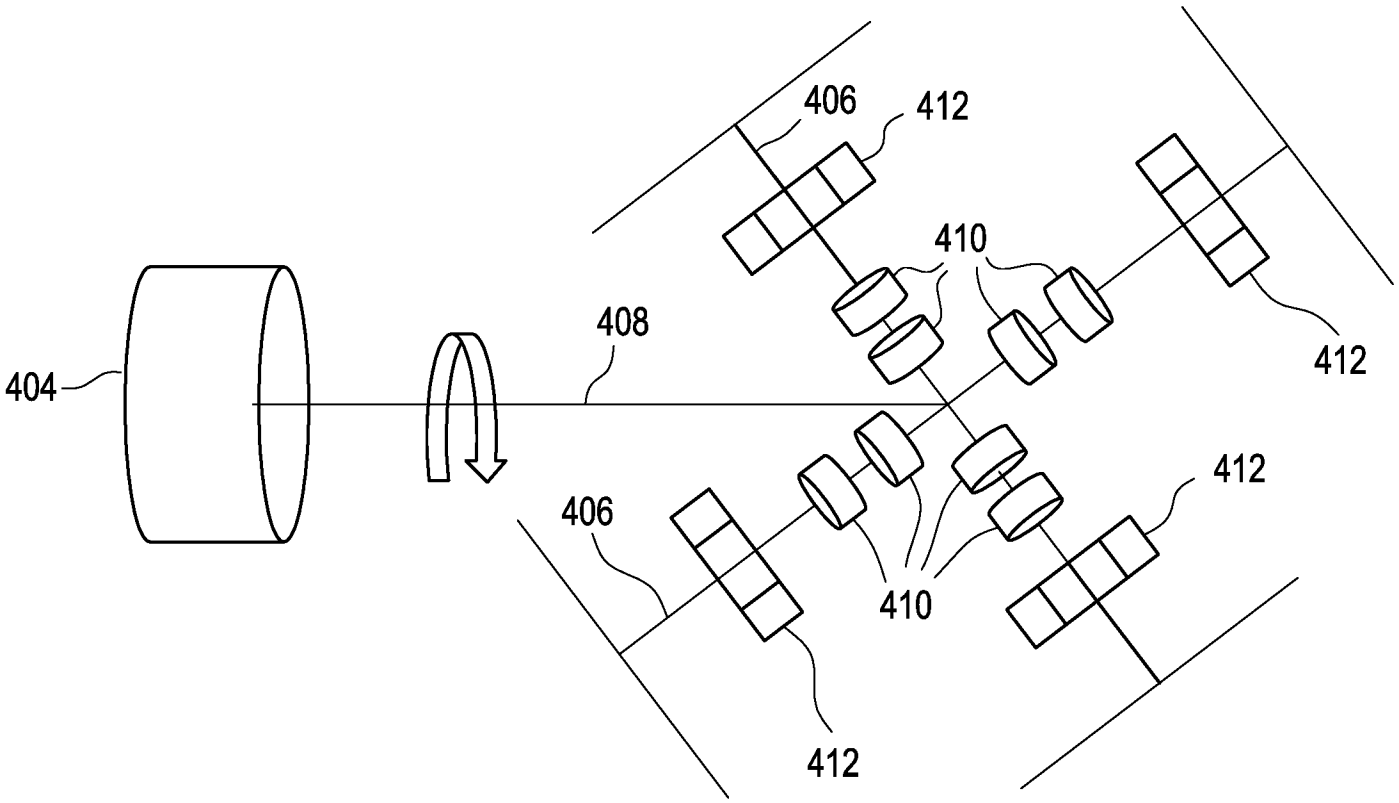
FIG. 6A is an illustration of a four-sided platen carrier in accordance with one embodiment.
Figure 6B:
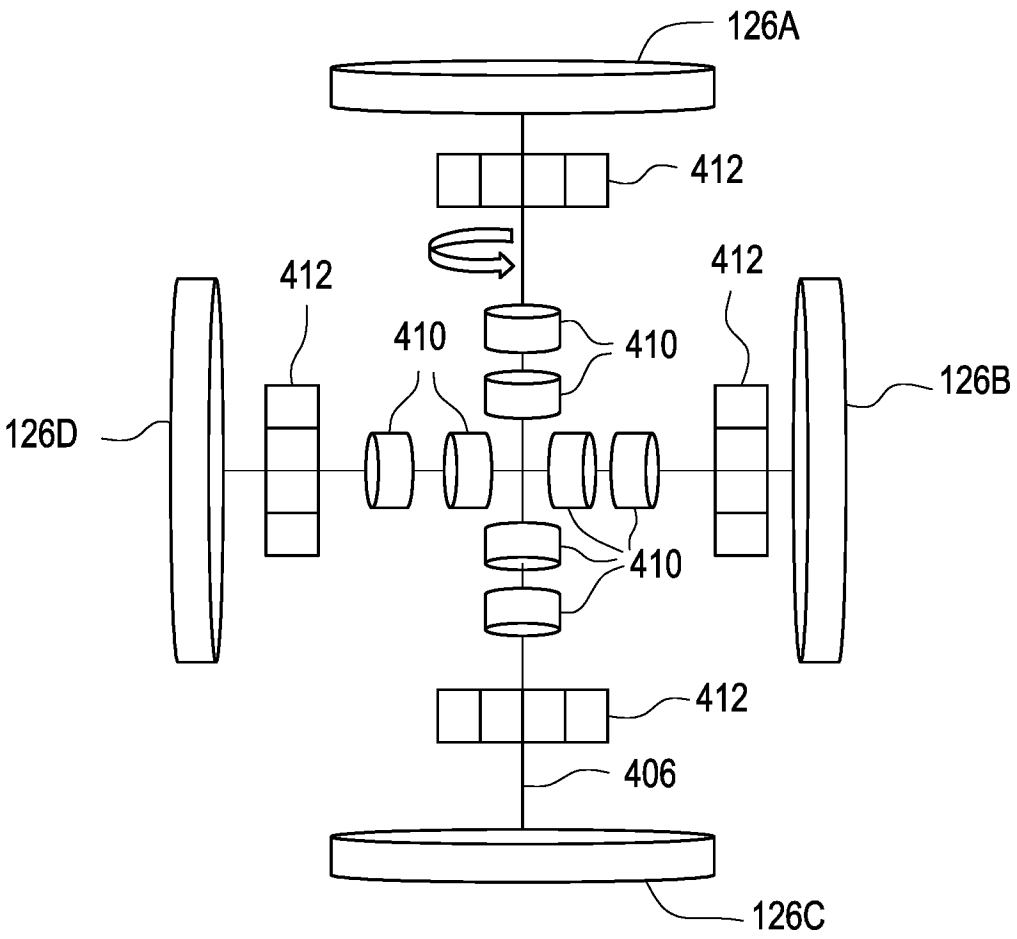
FIG. 6B is another illustration of the four-sided platen carrier of FIG. 6A in accordance with one embodiment.

The platen carrier 402 in FIG. 4 depicts two platens 126A and 126B to allow for illustration of the various internal drive components of the platen cleaning process module 302. It will be appreciated that a four-sided platen carrier 500 may also be utilized in the chamber 400 of FIG. 4, such as the four-sided platen carrier 500 that is illustrated in FIGS. 5A, 6A and 6B. Each platen 126A-126B is rotatably coupled to a central shaft 406 that extends between the platens 126A-126B. The rotation motor 404 is coupled to a drive shaft 408 connected to the central shaft 406. Positioned on the central shaft 406 are a plurality of couplings 410, configured to allow the platens 126A-126B to be spun independent from the rotation of the central shaft 406, as well as from each other. That is, each platen 126A-B (FIG. 4, and platens 126A-D in FIGS. 6A-6B) are independently rotatable via the couplings 410. A pulley or gear (sprocket) or other drive coupling mechanism 412 is positioned around the central shaft 406 adjacent each platen 126A, 126B and is configured to engage a corresponding drive coupling mechanism 414 of a platen rotation motor 416. During the CMP process, the platen rotation motor 416 operates to spin the platen 126A via the drive coupling mechanisms 414 and 412.

According to one embodiment, the platen rotation motor 416 is mounted to a support structure 418 that extends towards and retracts from the central shaft 406. That is, the support structure 418 moves the platen rotation motor 416 and drive coupling mechanism 414 to engage with or disengage from the drive coupling mechanism 412 associated with the platen 126A or 126B. In accordance with one embodiment, the support structure 418 is driven by a sweep motor 420 via a screw drive 422. That is, rotation of the screw drive 422 by the sweep motor 420 moves the support structure 418 toward or away from the central shaft 406. It will be appreciated by those skilled in the art that the location of the sweep motor 420 and screw drive 422 is dependent upon the location of the support structure 418. Further, the skilled artisan will appreciate that the platen drive motor 418 and associated components are positioned perpendicularly to the rotation of the platen carrier 402, as illustrated in FIG. 4. An exhaust 424 is arranged on an outside portion of the interior chamber 400 of the platen cleaning process module 302 enabling removal of moisture and/or providing access to the pad waste bin module 304. Located on a bottom portion of the interior chamber 400 of the platen cleaning process module 302 is a fan 426, proximate to the platen 126B and operable to dry out the pad located on the platen 126B of any residual moisture, e.g., water, slurry, or the like.

In accordance with one embodiment, the interior chamber 400 of the platen cleaning process module 302 further includes a pad tearer tool 504, illustrated in FIGS. 5A and 5B, that is configured to remove used pads 108 from a platen 126A-D during CMP pad replacement operations. In varying embodiments contemplated herein, the pad tearer tool 504 is movable along one or more axes, allowing the tool 504 to move into position to remove a used pad 108 from a platen 126A-D. According to one embodiment, the pad tearer tool 504 may utilize a 30-60 degree angle to remove the pad 108 from a platen 126A-D. The platen carrier 402 may rotate, causing the pad tearer tool 504 to peel the used pad 108 from the platen 126A-D. In some embodiments, the pad tearer tool 504 may move along one or more axes as the platen carrier 402 rotates to ensure proper removal of the pad 108 and to prevent damage to the platen 126A-D. The pad tearer tool 504 may then return to its original position after removal of the pad 108. In some embodiments, the pad tearer tool 504 is in communication with a receptacle, e.g., the pad waste bin module 304, to recover the pad 108 that is removed. Operations of the various components described above will be better understood in conjunction with the methodologies discussed with respect to FIG. 9.

Figure 8:
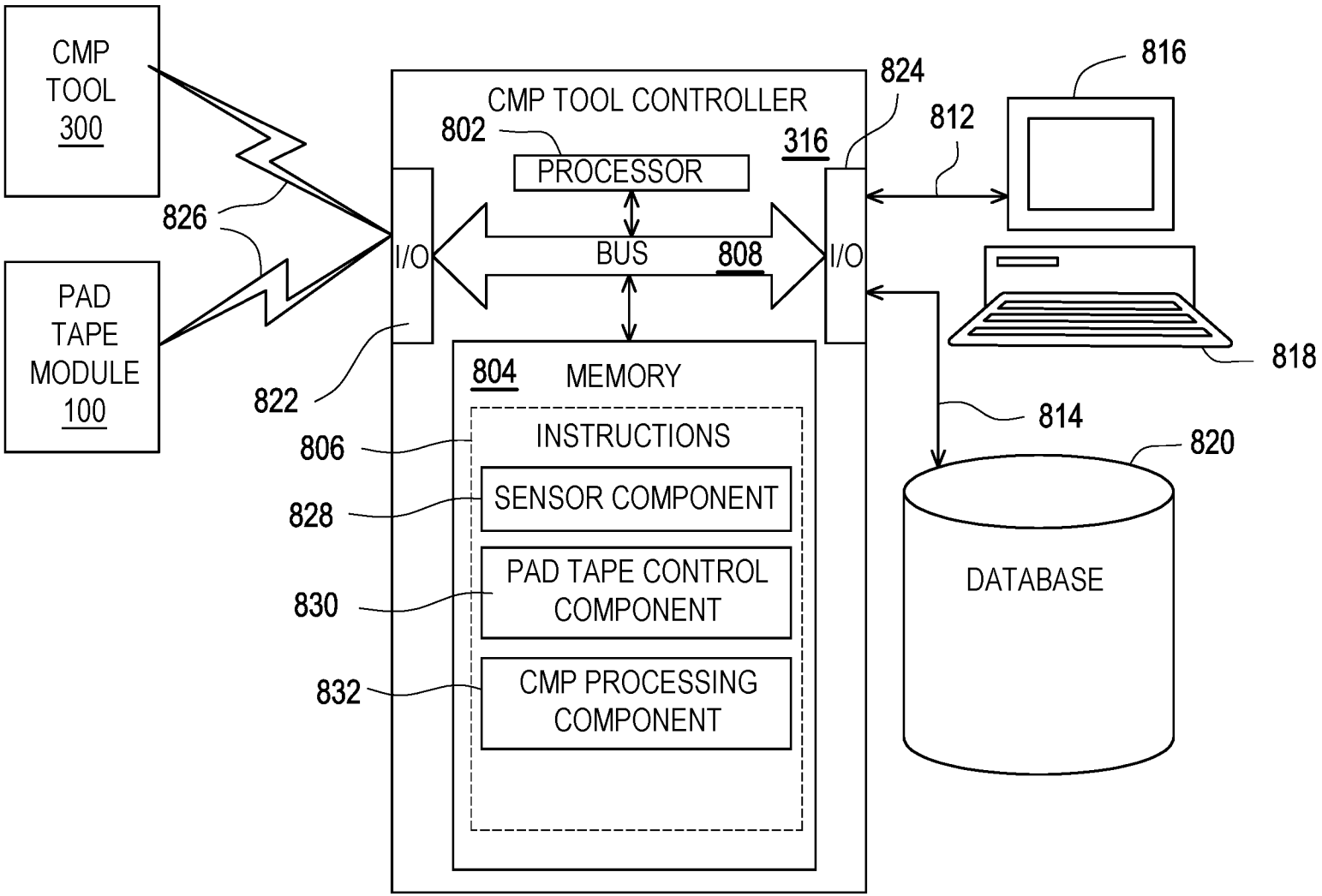
FIG. 8 is an illustration of a controller of a CMP tool in accordance with one embodiment.

Turning now to FIG. 8, there is shown a block diagram of a CMP tool controller 316 in accordance with one embodiment. The various components of the CMP tool controller 316 may be connected by a data/control bus 808. The processor 802 of the CMP tool controller 316 is in communication with an associated database 820 via a link 814. A suitable communications link 814 may include, for example, the public switched telephone network, a proprietary communications network, infrared, optical, or other suitable wired or wireless data communications. The database 820 is capable of implementation on components of the CMP tool controller 316, e.g., stored in local memory 804, i.e., on hard drives, virtual drives, or the like, or on remote memory accessible to the CMP tool controller 316.

The associated database 820 is representative of any organized collections of data used for one or more purposes. The skilled artisan will appreciate that such information may be updated via machine learning during operations of the subject CMP tool system 300 and/or the pad tape replacement module 100. Implementation of the associated database 820 is capable of occurring on any mass storage device(s), for example, magnetic storage drives, a hard disk drive, optical storage devices, flash memory devices, or a suitable combination thereof. The associated database 820 may be implemented as a component of the CMP tool controller 316, e.g., resident in memory 804, or the like. In one embodiment, the associated database 820 may include data corresponding to production scheduling, pad wear information, slurry information, lot information, platen orientation information, and the like.

The CMP tool controller 316 may include one or more input/output (I/O) interface devices 822 and 824 for communicating with external devices. The I/O interface 824 may communicate, via communications link 812, with one or more of a display device 816, for displaying information, such estimated destinations, and a user input device 818, such as a keyboard or touch or writable screen, for inputting text, and/or a cursor control device, such as mouse, trackball, or the like, for communicating user input information and command selections to the processor 802. The I/O interface 822 may communicate with external devices such as the CMP tool 300, the pad tape replacement module 100, the platen cleaning process module 302, the pad bubble detection module 306, the pad conditioner module 308, polish head module 310, pad wear detection module 312, the slurry flow module 314, and the various components associated therewith via the communications links 826.

It will be appreciated that the CMP tool controller 316 illustrated in FIG. 8 is capable of implementation using a distributed computing environment, such as a computer network, which is representative of any distributed communications system capable of enabling the exchange of data between two or more electronic devices. It will be further appreciated that such a computer network includes, for example and without limitation, a virtual local area network, a wide area network, a personal area network, a local area network, the Internet, an intranet, or any suitable combination thereof. Accordingly, such a computer network comprises physical layers and transport layers, as illustrated by various conventional data transport mechanisms, such as, for example and without limitation, Token-Ring, Ethernet, or other wireless or wire-based data communication mechanisms. Furthermore, while depicted in FIG. 8 as a networked set of components, the CMP tool controller 316 is capable of implementation on a stand-alone device adapted to interact with the CMP tool 300 and/or the pad tape replacement module 100 described herein.

The CMP tool controller 316 may include one or more of a computer server, workstation, personal computer, cellular telephone, tablet computer, pager, combination thereof, or other computing device capable of executing instructions for performing the exemplary method.

According to one example embodiment, the CMP controller 316 includes hardware, software, and/or any suitable combination thereof, configured to interact with an associated user, a networked device, networked storage, remote devices, or the like.

The memory 804 illustrated in FIG. 8 as a component of the CMP tool controller 316 may represent any type of non-transitory computer readable medium such as random access memory (RAM), read only memory (ROM), magnetic disk or tape, optical disk, flash memory, or holographic memory. In one embodiment, the memory 804 comprises a combination of random access memory and read only memory. In some embodiments, the processor 802 and memory 804 may be combined in a single chip. The network interface(s) 822, 824 allow the computer to communicate with other devices via a computer network, and may comprise a modulator/demodulator (MODEM). Memory 804 may store data processed in the method as well as the instructions for performing the exemplary method.

The digital processor 802 can be variously embodied, such as by a single core processor, a dual core processor (or more generally by a multiple core processor), a digital processor and cooperating math coprocessor, a digital controller, or the like. The digital processor 802, in addition to controlling the operation of the CMP tool controller 316, executes instructions 806 stored in memory 804 for performing the method set forth hereinafter.

As shown in FIG. 8, the instructions 806 stored in memory 804 may include a sensor component 828 configured to receive an output from one or more sensors, e.g. the bubble detection head 324 and/or pad wear detection sensor module 312. In some embodiments, the sensor component 828 is configured to determine from the received output whether the pad 108 is flat (i.e. no bubbles, deformities, etc.), the wear of the pad 108, and the like. When the output from the bubble detection head 324 indicates that one or more sensors indicate the presence of a bubble or other deformity on a pad 108, the sensor component 828 may generate feedback to the processor 802 to alert a technician that pad replacement is needed. Such an alert may include, for example and without limitation, an audible alert, a visual alert, a text message, an electronic mail message, an automated call, or the like. The sensor component 828 may further be configured to receive an output from the pad wear detection sensor module 312, indicative of a tear, worn portion, number of operations, passage of a predetermined period of time, or the like. In the event that such an output is received via the sensor component 828, the component 828 may generate the aforementioned feedback to the processor 802 as discussed above.

The instructions 806 stored in the memory 804 of the CMP tool controller 316 may further include a pad tape module control component 830 configured to determine a current position of the pad tape replacement module 100, the status of the pad tape supply 104, and the like. In some embodiments, the pad tape module control component 830, in conjunction with the processor 802, may direct movement of the pad tape replacement module 100 toward or away from the CMP tool 300, orientation and position of the platen carrier 402, orientation and position of the pad tearer tool 504, position and operation of rollers (e.g., operations of the pressure roller 124) and the like. According to other embodiments, the pad tape module control component 830 may be configured to operate the various motors associated with the platen cleaning process module 302, including rotation of the platen carrier 402 via the rotation motor 404, positioning of the sweep motor 420 and screw drive 422, and the like.

The memory 804 of the CMP tool controller 316 may further store a CMP processing component 832 in the instructions 806 configured to control a CMP process to be performed by the CMP tool 300. In some embodiments, the CMP processing component directs operations of the pad conditioner module 308, the polish head module 310, and the slurry flow module 314 in accordance with a given CMP polishing operation. It will be appreciated that the CMP processing component 832, via the processor 802, may direct movement of the sweep motor 420 to engage and rotate the platen 126A via the drive coupling mechanisms 412, 414. The skilled artisan will appreciate that the CMP processing component 832 may further be configured to control rotation of the various motors discussed above with respect to FIG. 4 to facilitate a polishing process on an associated wafer 340.

The term "software" as used herein is intended to encompass such instructions stored in storage medium such as RAM, a hard disk, optical disk, or so forth, and is also intended to encompass so-called "firmware" that is software stored on a ROM or so forth. Such software may be organized in various ways, and may include software components organized as libraries, Internet-based programs stored on a remote server or so forth, source code, interpretive code, object code, directly executable code, and so forth. It is contemplated that the software may invoke system-level code or calls to other software residing on a server or other location to perform certain functions. Operations of the CMP tool controller 316 will be better understood in conjunction with the exemplary methods set forth in FIG. 9.

Figure 9:
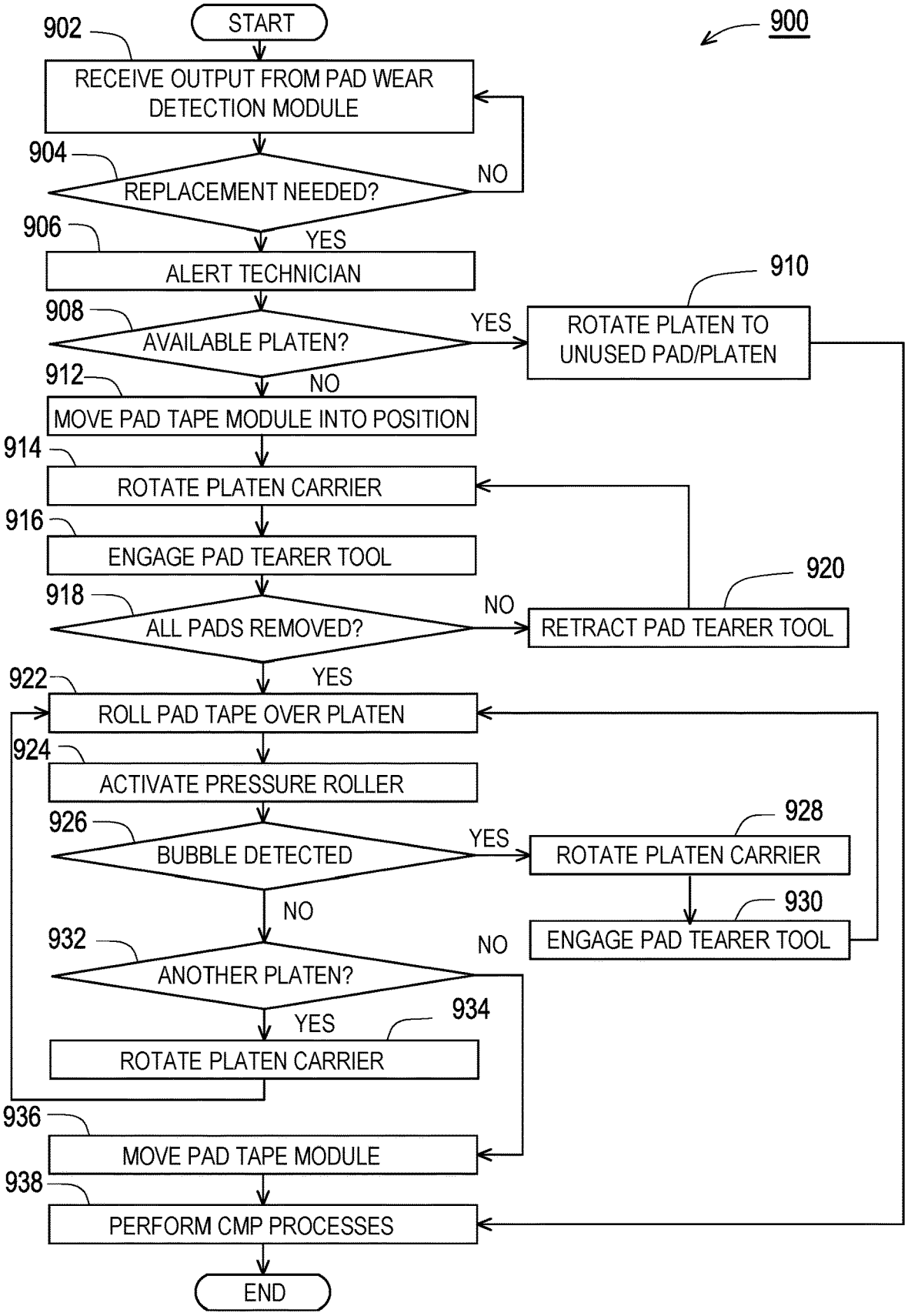
FIG. 9 is a flowchart illustrating a method for CMP pad replacement in accordance with one embodiment.

Turning now to FIG. 9, there is shown a flowchart illustrating a method 900 for in-situ CMP pad replacement in accordance with one embodiment. The method 900 begins at 902, whereupon the CMP tool controller 316 via the sensor component 828 receives output from the pad wear detection module 306 regarding a pad 108 currently being used in CMP polishing operations of the CMP tool 300. A determination is then made at 904 whether replacement of the pad 108 is required. In varying embodiments, the determination may be made based upon the usage of the pad, i.e., number of wafers 340 polished, number of polishing operations, and the like. In accordance with other embodiments, the determination may be made based upon detected wear of the pad 108, i.e., holes, lack of abrasive qualities, thinness/thickness of the pad 108, or the like. Upon a negative determination at 904, operations return to 902 for continued monitoring of the output from the pad wear detection module 312.

When it is determined at 904 that replacement of the pad 108 is needed, operations proceed to 906, whereupon a technician is alerted. After such an alert, a determination is made at 908 whether another platen 126A, 126B, 126C, or 126D is available for use. That is, a determination is made whether one of the platens 126A, 126B, 126C, or 126D remains available with an unused pad 108. It will be appreciated that the availability of an unused pad 108 may be dependent upon the number of platens on the carrier 402, i.e. two, four, or more. Upon a positive determination at 908, operations proceed to 910, whereupon the platen carrier 402 is rotated to allow the unused pad 108/platen 126A, 126B, 126C, or 126D to be positioned on the top 320 of the CMP tool 300. Operations then proceed to 938, whereupon CMP processing is performed by the CMP tool 300 using the unused pad 108.

Upon a determination at 908 that no unused pads 108 remain available, the CMP tool controller 316 directs movement of the pad tape replacement module 100 into position over the CMP tool 300 at 912, as well as rotation of the various modules 306, 308, 314 away from the platen 126A, 126B, 126C, or 126D. The CMP tool controller 316 directs rotation of the platen carrier 402 toward the pad tearer tool 504 (as illustrated in FIGS. 5A-5B) at 914. Concurrently or sequentially therewith, at 916, the pad tearer tool 504 is engaged to tear/remove the used pad 108 from the platen 126A, 126B, 126C, or 126D. A determination is then made at 918 whether all platens 126A, 126B, 126C, and 126D have been cleared of used pads 108. When a platen 126A, 126B, 126C, or 126D has not yet been cleared of a used pad 108, operations proceed to 920, whereupon the pad tearer tool 504 is retracted so as to prevent damage to the tool 504 and/or the platens 126A, 126B, 126C, or 126D. Operations then return to 914, whereupon the platen carrier 402 is rotated and the pad tearer tool 504 is engaged at 916 to remove the used pad 108 from the platen 126A, 126B, 126C, or 126D. It will be appreciated by those skilled in the art that during the aforementioned cleaning operations, the fan 426 is activated to dry/remove excess fluids on the platen 126A, 126B, 126C, or 126D positioned on the bottom of the interior chamber 400 as the carrier 402 rotates.

Upon a determination at 918 that all used pads have been removed, operations proceed to 922, whereupon the pad tape 106 is rolled over the current platen 126A, 126B, 126C, or 126D positioned at the top of the CMP tool 300. That is, the backing tape 112 is removed via backing rollers 110A-B, leaving the pad 108 in the pad layer 122 with the adhesive layer 120 exposed, and the pad tape supply roller 102, the backing recycle roller 116, and the pad tape recycle roller 130 are activated to increment/advance the pad tape 106 such that a fresh pad 108 disposed in the pad tape 106 is in the correct position above the platen 126A, 126B, 126C, or 126D for application thereto. At 924, the pressure roller 124 is engaged to apply downward force to the pad tape 106 above the platen 126A, 126B, 126C, or 126D and to roll across the platen 126A, 126B, 126C, or 126D providing constant, even pressure on the pad 108 to enable the adhesive 122 to adhere or otherwise engage with the platen 126A, 126B, 126C, or 126D.

A determination is then made at 926 whether any bubbles (or other deformities) are detected via output of the bubble detection module 306. In accordance with another embodiment contemplated herein, the pad tape replacement module 100 may be positioned on a side of the CMP tool 300, i.e., on a side of the platen cleaning process module 302, as opposed to the top of the platen cleaning process module 302. In such an embodiment, the skilled artisan will appreciate that the pad bubble detection module 306 may be positioned on the same side as that of the pad tape replacement module 100 for performance of bubble detection as discussed above.

Upon a determination that a bubble or other deformity is detected, operations proceed to 928, whereupon the platen carrier 402 is rotated and the tearer tool 504 is engage at 930. Operations then return to 922 and the pad tape 106 is rolled over the next platen 126A, 126B, 126C, or 126D. Upon a determination at 926 that no bubbles or other deformities are detected, operations proceed to 932. At 932, a determination is made whether another platen 126A, 126B, 126C, or 126D remains for pad replacement. Upon a positive determination, operations proceed to 934, whereupon the platen carrier 402 is rotated and flow returns to 922 for continued operation.

When it is determined that no other platens 126A, 126B, 126C, or 126D remain for pad replacement, operations progress to 936, whereupon the pad tape replacement module 100 is retracted/moved from above the CMP process tool 300. CMP processing by the CMP process tool 300 then resumes at 938.

In accordance with a first embodiment, there is provided a method for in-situ chemical mechanical polishing (CMP) pad replacement in an associated CMP tool. The method includes receiving, at a controller including a processor in communication with memory, an output from a pad wear detection module corresponding to a state of a CMP pad on a first platen of a plurality of platens of a platen carrier. The method further comprises positioning a pad tape replacement module proximate to the first platen responsive to an output of the pad wear detection module, the pad tape replacement module including a pad tape supply containing a plurality of pads. The method further includes rotating the platen carrier toward a pad tearer tool movably positioned adjacent to the platen carrier, and engaging the pad tearer tool to remove the CMP pad on the first platen. Furthermore, the method includes the step of rolling, via a pressure roller of the pad tape replacement module, a pad disposed in the pad tape supply onto a second platen of the plurality of platens of the platen carrier.

In accordance with a second embodiment, there is provided chemical mechanical polishing (CMP) pad replacement system. The system includes a pad tape replacement module configured to removably engage a platen of an associated CMP processing tool, and a CMP tool controller in communication with the pad tape replacement module and the associated CMP processing tool. The pad tape replacement module includes a pad tape supply roller that stores pad tape, at least one backing removal roller, a backing recycle roller, a pressure roller, and a pad tape recycle roller. The CMP tool controller includes a processor in communication with memory, with the memory storing instructions that are executed by the processor and cause the processor to receive an output from a pad wear detection module corresponding to a state of a CMP pad on a first platen of a plurality of platens of a platen carrier, as well as to position the pad tape replacement module proximate to the first platen responsive to an output of the pad wear detection module. Furthermore, the instructions cause the processor to rotate the platen carrier toward a pad tearer tool movably positioned adjacent to the platen carrier, and to engage the pad tearer tool to remove the CMP pad on the first platen; and roll, via the pressure roller, a pad disposed in the pad tape onto a second platen of the plurality of platens of the platen carrier.

In accordance with a third embodiment, there is provided chemical mechanical polishing (CMP) device. The CMP device includes a platen carrier positioned within an interior chamber of the CMP device and comprising a plurality of independently rotatable platens. The device further includes a plurality of polishing pads correspondingly affixed to each of the independently rotatable platens, and a rotation motor coupled to a central shaft of the platen carrier and configured to rotate the platen carrier. In addition, the device includes a platen rotation motor removably coupled to at least one platen, the platen rotation motor configured to rotate the at least one platen during chemical mechanical polishing operation.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; and electrical, optical, acoustical or other form of propagated signals (e.g., carrier waves, infrared signals, digital signals, etc.), just to mention a few examples.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method for in-situ chemical mechanical polishing (CMP) pad replacement in an associated CMP tool, comprising:

receiving, at a controller including a processor in communication with memory, an output from a pad wear detection module corresponding to a state of a CMP pad on a first platen of a plurality of platens of a platen carrier;

positioning a pad tape replacement module proximate to the first platen responsive to an output of the pad wear detection module, the pad tape replacement module including a pad tape supply having a plurality of pads disposed therein;

rotating the platen carrier toward a pad tearer tool movably positioned adjacent to the platen carrier;

engaging the pad tearer tool to remove the CMP pad on the first platen; and rolling, via a pressure roller of the pad tape replacement module, a pad disposed in the pad tape supply onto a second platen of the plurality of platens of the platen carrier.

2. The method of claim 1, further comprising detecting, via a pad bubble detection module, at least one deformity in the pad on the second platen.

3. The method of claim 2, further comprising rotating the platen carrier toward the pad tearer tool to remove the pad on the second platen.

4. The method of claim 1, further comprising advancing the pad tape supply to position a new pad over the second platen.

5. The method of claim 4, further comprising separating a backing layer from the pad tape supply prior to advancing the pad tape supply.

6. The method of claim 1, further comprising generating an alert responsive to an output of the pad wear detection module.

7. The method of claim 1, wherein the pad tape replacement module comprises: a pad tape supply, a backing recycle roller, the pressure roller, and a pad tape recycle roller.

8. The method of claim 1, wherein the platen carrier is four-platen carrier or a two platen carrier.

9. The method of claim 1, wherein the pad tape comprises a pad layer, a backing layer, and an adhesive.

10. The method of claim 1, wherein the pad tape is precut into pads corresponding to a size of each of the plurality of platens.

11. A chemical mechanical polishing (CMP) pad replacement system comprising:

a pad tape replacement module configured to removably engage a first and second rotatable platen of an associated CMP processing tool, the CMP processing tool comprising:

a rotatable platen carrier including the first rotatable platen and the second rotatable platen, a first CMP pad affixed to the first rotatable platen, a pad wear detection module configured to output a state of the first CMP pad affixed to the first rotatable platen, and a pad tearer tool configured to rotate and engage the first rotatable platen to remove the first CMP pad therefrom;

the pad tape replacement module comprising:

a pad tape supply roller storing pad tape, at least one backing removal roller, a backing recycle roller, a pressure roller, and a pad tape recycle roller; and a CMP tool controller in data communication with the pad tape replacement module and the CMP processing tool, and the CMP tool controller including a processor in communication with a memory, wherein the memory stores instructions which are executed by the processor causing the processor to:

receive an output from a wear detection sensor operatively associated with the pad wear detection module corresponding to a state of the first CMP pad on the first rotatable platen of the rotatable platen carrier;

using an operatively connected first motor to position the pad tape replacement module proximate to the first rotatable platen responsive to an output of the pad wear detection module;

using an operatively connected second motor to rotate the rotatable platen carrier toward the pad tearer tool movably positioned adjacent to the rotatable platen carrier;

using an operatively connected third motor to engage the pad tearer tool to remove the first CMP pad affixed to the first rotatable platen; and roll, via the pressure roller, a second CMP pad disposed in the pad tape onto the second rotatable platen of the rotatable platen carrier.

12. The system of claim 11, further comprising a pad bubble detection module configured to detect at least one deformity in the second CMP pad on the second platen.

13. The system of claim 12, wherein the memory further stores instructions which are executed by the processor causing the processor to rotate the rotatable platen carrier toward the pad tearer tool to remove the second CMP pad on the second rotatable platen.

14. The system of claim 11, wherein the pad tape comprises a pad layer, a backing layer, and an adhesive, and wherein the at least one backing removal roller is configured to separate the backing layer from the pad tape.

15. The system of claim 11, wherein the rotatable platen carrier is four-platen carrier or a two-platen carrier.

16. A chemical mechanical polishing (CMP) device, comprising:

a platen carrier positioned within an interior chamber of the CMP device and comprising a plurality of independently rotatable platens coupled thereto;

a plurality of polishing pads correspondingly affixed to each of the independently rotatable platens;

a rotation motor coupled to a central shaft of the platen carrier and configured to rotate the platen carrier;

a platen rotation motor removably coupled to at least one platen, the platen rotation motor configured to rotate the at least one platen during chemical mechanical polishing operation; and a pad tearer tool positioned within the chamber, the pad tearer tool configured to rotate and engage one of the platens to remove a pad therefrom.

17. The device of claim 16, further comprising a support structure configured to support the platen rotation motor, wherein the support structure is movable relative to the central shaft via a sweep motor.

18. The device of claim 16, wherein each of the plurality of platens further comprises a corresponding drive coupling mechanism configured to engage with the platen rotation motor.

19. The device of claim 16, further comprising a pad tape replacement module configured to removably engage one of the plurality of independently rotatable platens, the pad tape replacement module comprising:

a pad tape supply roller storing pad tape, at least one backing removal roller, a backing recycle roller, a pressure roller, and a pad tape recycle roller.

20. The device of claim 16, wherein the platen carrier is four-platen carrier or a two platen carrier.

* * * * *